United States Patent [19]

Parsons

[11] 3,937,552

[45] Feb. 10, 1976

[54] TERMINAL INSULATOR METHOD OF MANUFACTURING SAME, AND TERMINAL ASSEMBLY INCLUDING THE SAME

[75] Inventor: William Thomas Parsons, Hemel Hempstead, England

[73] Assignee: Joseph Lucas (Industries) Limited, Birmingham, England

[22] Filed: Nov. 20, 1974

[21] Appl. No.: 525,635

[30] Foreign Application Priority Data

Dec. 1, 1973 United Kingdom ..... 55805/73

[52] U.S. Cl. ..... 339/213 R; 29/631; 83/54; 174/138 F; 339/198 J

[51] Int. Cl.[2] ..... H01R 13/44; H01B 19/00

[58] Field of Search .... 174/5 R, 71 R, 74 A, 138 F, 174/153 G; 339/36, 114, 115 R, 115 C, 116 R, 116 C, 198 J, 201, 213 R, 213 T, 263 R; 29/631; 83/54

[56] References Cited

UNITED STATES PATENTS

| | | | |
|---|---|---|---|
| 265,746 | 10/1882 | Brewtnall | 174/138 F UX |
| 2,424,757 | 7/1947 | Klumpp, Jr. | 174/153 G |
| 2,636,065 | 4/1953 | Fiske | 174/138 F X |
| 2,740,001 | 3/1956 | Vergilio et al. | 174/138 F |
| 2,749,529 | 6/1956 | Curtiss | 174/138 F UX |
| 2,904,617 | 9/1959 | King | 174/153 G UX |
| 3,013,106 | 12/1961 | Cornell | 174/138 F X |
| 3,125,499 | 3/1964 | Bender | 174/138 F X |
| 3,441,661 | 4/1969 | Brummans | 174/138 F |

*Primary Examiner*—Laramie E. Askin
*Attorney, Agent, or Firm*—Holman & Stern

[57] ABSTRACT

A terminal insulator comprising a tubular component formed from flexible insulating material. In one axial region the wall of the component is formed with slits which define a displaceable flap integral with the remainder of the component. The flap is such that displacement thereof produces in said axial region of the component an aperture, the remainder of said region defining a shroud. The component further includes an additional axial region which is unaffected by said slits and so defines an unbroken collar. A method of manufacturing such a terminal insulator and a terminal assembly utilising such an insulator are also disclosed.

3 Claims, 11 Drawing Figures

TERMINAL INSULATOR METHOD OF MANUFACTURING SAME, AND TERMINAL ASSEMBLY INCLUDING THE SAME

This invention relates to insulators for use particularly, but not exclusively, with terminal posts.

An insulator according to the invention comprises a tubular component formed from flexible insulating material, the wall of one axial region of said tubular component being formed with slits which define therein a displaceable flap such that displacement of the flap relative to the remainder of the component produces in said axial region an aperture, and the remainder of said region defines a shroud, said component including a further axial region which is unaffected by said slits, and so defines an unbroken collar.

In a second aspect the invention resides in a method of manufacturing a terminal insulator comprising starting with a length of flexible, insulating tubular material, and forming in one axial region of the wall of the tube slits which define between them a displaceable flap, which, when displaced, leaves in the wall of the tube an aperture such that the remainder of said axial region defines a shroud, the slits being so positioned that a further axial region of the tube is unaffected by the slits, and so defines an unbroken collar.

In a further aspect the invention resides in a terminal assembly including a base, a terminal post upstanding from the base, a connector engaged with the terminal post and extending generally at right angles to the terminal post, and an insulator as specified above, said flap being displaced to lie generally parallel with the connector, the connector extending through said aperture, and said collar encircling said terminal post and being trapped between the connector and the base so as to retain the insulator in position relative to the terminal post and connector.

Figure 1:
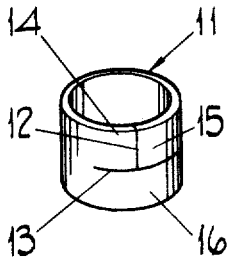
Figure 2:
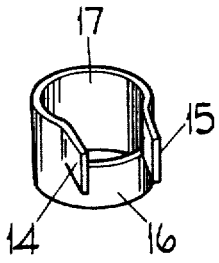
Figure 3:
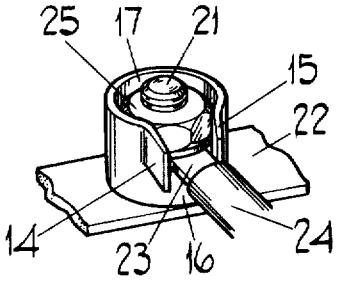
Figure 4:
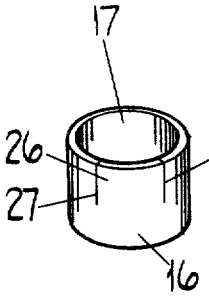
Figure 5:
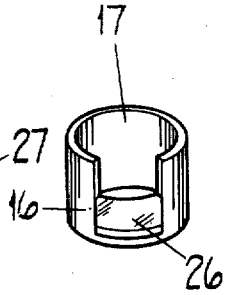
Figure 6:
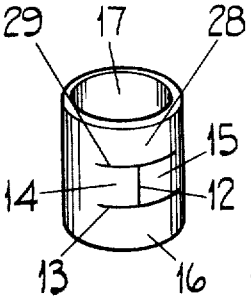
Figure 7:
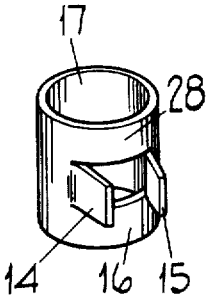
Figure 8:
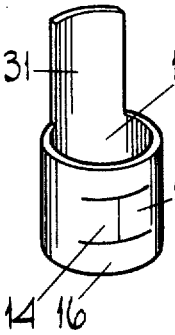
Figure 9:
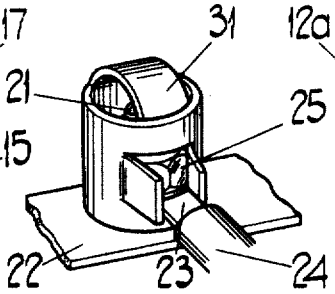
Figure 10:
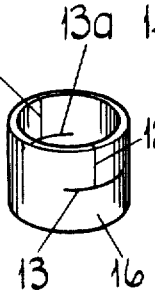
Figure 11:
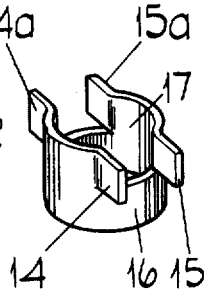

In the accompanying drawings, FIG. 1 illustrates a terminal insulator in accordance with a first example of the invention, prior to use in a terminal assembly, FIG. 2 shows the insulator of FIG. 1 ready to be incorporated in a terminal assembly, FIG. 3 shows the insulator of FIG. 1 incorporated in a terminal assembly, FIGS. 4 and 5 are views similar to FIGS. 1 and 2 of an insulator in accordance with a second example of the invention, FIGS. 6 and 7 are views similar to FIGS. 1 and 2 of an insulator in accordance with a third example of the invention, FIGS. 8 and 9 are views similar to FIGS. 1 and 3 of an insulator and its incorporation in a terminal assembly in accordance with a fourth example of the invention, and FIGS. 10 and 11 are views similar to FIGS. 1 and 2 of an insulator in accordance with a fifth example of the invention.

Referring first to FIGS. 1 to 3 of the drawings, there is shown a terminal insulator for use with a screw-threaded terminal post which is arranged to receive a connector of the type including an eyelet which encircles the terminal post, and which is retained on the terminal post by means of a nut, with the connector extending generally at right angles to the terminal post.

The insulator 11 comprises a short length of polytetra-fluoroethylene tube which is formed with an axial slit 12 extending from one free end of the tube to a point approximately two thirds along the length of the tube. At its end remote from the free end of the tube the slit 12 communicates with a second, circumferential slit 13, the circumferential slit 13 of course extending generally at right angles to the slit 12. The slit 12 intersects substantially the mid-point of the slit 13, and the slit 13 subtends an angle between 90° and 180°. Thus, the two slits 12, 13 together define in the wall of the tube a pair of displaceable flaps 14, 15, and both slits lie in a first axial region of the tube. Neither slit extends into a second axial region of the tube adjacent the opposite free end of the tube, and so the second axial region of the tube can be considered to be an unbroken collar 16. When the two flaps 14, 15 are displaced relative to the remainder of the tube, by flexing them, they leave an aperture in the wall, and the remainder of the wall can be considered as a shroud 17 integral with and upstanding from the collar 16.

The insulator is used in the following manner, a terminal post 21 which is upstanding on a base 22 is arranged to receive an eyelet connector 23 having a lead 24 secured thereto. The eyelet connector 23 encircles the post 21 and is held in position by a conductive nut 25. The insulator is placed over the post 21 prior to engagement of the connector and nut with the post. The free end of the collar 16 seats against the base 22, and the flaps 14, 15 are displaced outwardly to provide an aperture through which the connector 23 can extend. The collar 16 encircles the post 21, and the shroud 17 partially encircles the post, the post being exposed at the open end of the shroud, and by way of the aperture defined when the flaps are displaced. The connector 23 is then engaged with the post 21 and the nut 25 is engaged with the post 21 to secure the connector in position. The connector extends outwardly from the post 21 by way of the aperture in the insulator, and the flaps 14, 15 lie on either side of the connector. The connector is held in position relative to the remainder of the terminal assembly by the collar 16 being trapped between the connector 23 and the base 22.

It will be appreciated that the shroud 17 and the flaps 14, 15 mask substantially the whole of the exposed conductive area of the terminal post, the nut, and the connector. Thus the possibility of short circuiting, or other unwanted electrical connection between closely adjacent terminal posts and their connectors is minimised.

In the example shown in FIGS. 4 and 5 it will be noted that again there is a collar 16, a shroud 17 and an aperture. However, in this example there is only a single flap, 26 defined by a pair of parallel, circumferentially spaced slits 27. The flap 26 is again displaced to extend outwardly from the remainder of the insulator, and in this example is intended to provide insulation between the connector, and conductive components lying beneath the connector.

The third example shown in FIGS. 6 and 7 is quite similar to the example shown in FIGS. 1, 2 and 3, with the exception that it includes a collar 28 at the end of the insulator remote from the collar 16. Again there are two flaps 14, 15 similar to the flaps 14, 15 of the first example. In this case however, the flaps are defined by three slits, two of which 12, 13 are similar to the slits 12, 13 of the first example, the third slit 29 being parallel to and spaced from the slit 13. The example shown in FIGS. 6 and 7 has the advantage over the arrangement shown in FIGS. 1 and 2 that if used with the terminal construction shown in FIG. 3, then there is a greater shrouding of the upper end of the terminal by virtue of the collar 28. Additionally, of course, the insulator shown in FIGS. 6 and 7 can be used either way up. As will be appreciated, there is a slight difference in the sequence of construction of the terminal assembly in that the connector 23 must be inserted through the aperture defined between the flaps 14, 15 prior to engagement of the insulator and the connector over the terminal post.

The example shown in FIGS. 8 and 9 differs from the example shown in FIGS. 6 and 7 only in that the shroud 17 is formed with an axially extending integral strip 31 which can be folded over the top of the terminal post 21 and nut 25 after construction of the terminal assembly to substantially close the upper end of the insulator.

The example shown in FIGS. 10 and 11 is a version of the example shown in FIGS. 1 and 2 capable of accepting a double ended connector. Thus the tube is formed with a second pair of slits 12*a*, 13*a* identical with and diametrically opposite the slits 12, 13. The slits 12*a*, 13*a* define a second pair of displaceable flaps 14*a*, 15*a* diametrically opposite the flaps 14, 15, and when the flaps 14*a*, 15*a* are displaced they leave an aperture in the shroud 17 diametrically opposite the aperture between the flaps 14, 15. Thus a double ended connector can be accommodated, or alternatively a pair of connectors 23 engaged with the same post, but extending in opposite directions, can be accommodated. It will be appreciated, of course, that the shroud 17 is in this example in two separate parts each of which partially encircles the terminal assembly.

It will be recognised that a large number of different forms of insulator can be produced merely by altering the number and positioning of the slits. Furthermore, it will be manifest that the various forms of insulator can be produced both cheaply and conveniently when needed, since all that is necessary is a stock of the appropriate tubing, and a sharp knife. However, where one particular form of connector is to be used widely, then it is quite possible that that single form of connector could be produced in a moulding operation.

I claim:

1. A terminal insulator comprising a tubular component formed from flexible insulating tube, the wall of one axial region of said tubular component being formed with slits which define therein a displaceable flap such that displacement of the flap relative to the remainder of the component produces in said axial region an aperture and the remainder of said region defines a shroud, said component including a further axial region which is unaffected by said slits and so defines an unbroken collar, and said component further including an integral flexible strip which extends axially from the axial end of the component remote from the unbroken collar, the strip being of a length and width such that it can be folded over relative to the component to substantially close said axial end of the component.

2. A method of manufacturing a terminal insulator comprising starting with a length of flexible, insulating tube, and forming in one axial region of the wall of the tube slits which define between them a displaceable flap, which, when displaced, leaves in the wall of the tube an aperture such that the remainder of said axial region defines a shroud, the slits being so positioned that a further axial region of the tube is unaffected by the slits, and so defines an unbroken collar, and, removing part of the wall of the tube at the axial end thereof remote from said unbroken collar so as to leave, extending axially from said axial end of the tube, a flexible strip the length and width of which are such that the strip can be folded to substantially close said axial end of the tube.

3. A terminal assembly including a base, a terminal post upstanding from the base, a connector engaged with the terminal post and extending generally at right angles to the terminal post, and an insulator comprising a tubular component formed from flexible insulating tube, the tubular component having one axial region of the wall thereof formed with slits which define a displaceable flap such that displacement of the flap relative to the remainder of the component produces in said axial region an aperture, and the remainder of said region defines a shroud, said component including a further axial region which is unaffected by said slits and so defines an unbroken collar, and said component having an integral strip extending axially from the axial end of the component remote from the unbroken collar, said flap being displaced to lie generally parallel with the connector, the connector extending through said aperture, and the collar encircling said terminal post and being trapped between the connector and the base so as to retain the insulator in position relative to the terminal post and connector, said shroud shrouding the periphery of the terminal post and the connector, and said strip being folded to overlie the top of the terminal post, the length and width of the strip being such that the strip, when so folded, substantially closes said axial end of the insulator component.

* * * * *